United States Patent [19]

Janecek et al.

[11] 4,358,101

[45] Nov. 9, 1982

[54] SHEET FEEDER DEVICE FOR A PRINTING MACHINE

[75] Inventors: Jaroslav Janecek, Brno; Jaroslav Jiruse, Blansko; Josef Rozsypal, Adamov, all of Czechoslovakia

[73] Assignee: Adamovske strojirny, narodni podnik, Prague, Czechoslovakia

[21] Appl. No.: 265,406

[22] Filed: May 20, 1981

Related U.S. Application Data

[63] Continuation of Ser. No. 102,837, Dec. 12, 1979, abandoned.

[30] Foreign Application Priority Data

Dec. 28, 1978 [CS] Czechoslovakia ..... 9030-78

[51] Int. Cl.[3] ..... B65H 1/18; B65H 3/54

[52] U.S. Cl. ..... 271/12; 271/31; 271/152; 271/171

[58] Field of Search ..... 271/11, 12, 13, 30 R, 271/31, 90, 91, 93, 98, 104, 105, 107, 108, 152, 153, 154, 155, 156, 171, 223, 224, 10, 14, 15, 16, 17

[56] References Cited

U.S. PATENT DOCUMENTS 2,838,306 6/1958 Williams ..... 271/31
3,334,894 8/1967 Van Acker ..... 271/171 X
3,471,141 10/1969 Ruetschle ..... 271/93
3,862,753 1/1975 Giorgini ..... 271/171

FOREIGN PATENT DOCUMENTS 2038291 7/1980 United Kingdom ..... 271/31

*Primary Examiner*—Bruce H. Stoner, Jr.
*Attorney, Agent, or Firm*—Burgess, Ryan and Wayne

[57] ABSTRACT

A sheet feeder device for a printing machine, having a pneumatic feeder head including a regulating screw mounted therein and provided with a pressure spring which is arranged between a shoulder of the regulating screw and a rest which is attached to a two-arm lever. To the frame of the printing machine is fixed a spacer on which are adjustably arranged straightening elements provided with rigidly attached eccentrics. The eccentric is turnably mounted in a body, in which is also turnably arranged, a connecting screw which is provided with a centering ring and a catch which seats on a bar fixed to the side wall of the printing machine. The straightening element is provided with a stop, on which bears a lever which is attached to the eccentric. A guide piece is also fixed to the straightening element. The device according to the invention enables the feeding of letter envelopes without the need of a special auxiliary device to be mounted to the printing machine. While setting (adjusting) the printing machine from the operation of paper printing paper sheets for the printing of envelopes, or vice versa, it is not necessary to specially set the feeder device.

3 Claims, 6 Drawing Figures

SHEET FEEDER DEVICE FOR A PRINTING MACHINE

RELATED APPLICATION

This application is a continuation-in-part of copending application Ser. No. 102,837 filed Dec. 12, 1979 (now abandoned).

BACKGROUND OF THE INVENTION

This invention relates to a sheet feeder device, particularly for offset printing machines.

Known pneumatic sheet feeder devices transfer the paper sheets from a pile to the feeder which feeds the sheets in overlapped arrangement to the printing unit. Some feeder devices are arranged in such a way, that a special mechanism can be connected with the feeder device which enables the feeding of paper sheets of large size or of special forms.

The scope of the present invention is to provide a sheet feeder device, where the paper sheets are arranged in a pile and are transferred from the pile by means of a pneumatic sucker head to a transport device, whereby the feeder device enables the feeding also of letter envelopes or other cross-formed letters which are piled longitudinally or transversely. The same elements are used for the straightening of the paper sheet as well as for the forming of the pile of sheets. Further, the device according to the invention provides the possibility to replace the guide rollers with rollers which correspond according to the thickness and toughness of envelopes to be printed. The guide rollers can be easily and quickly adjusted according to the size of the paper sheets.

Other sheet feeder devices are known, to which a special accessory device can be connected, to enable the feeding also of piled envelopes or of similar material. This device works in such a way, that the envelopes arranged in a pile which is located in the accessory device, are pushed by a mechanical friction element to the transporting device and to the printing unit. The disadvantage of this device is in that the printing machine in this case has to be provided with a special accessory device for the feeding of envelopes which again has to be dismantled from the machine, when a different kind of printing work is to be done on the machine.

Other known devices which enable the feeding of letter envelopes or of other envelopes are arranged in such a way, that pneumatic suckers take the envelopes at their leading edge from the pile and transfer one envelope after the other to the transport device, with an appropriate distance being allowed between envelopes. A disadvantage of this feeder device is that the action of feeding envelopes limits the printing output of the printing machine, whereby the transport of envelopes, which are of small size, is not accurate.

SUMMARY

The described disadvantages are avoided by a feeder device according to the invention, where a regulating screw is arranged in a feeder head. The regulating screw is provided with a compression spring arranged between a shoulder of the regulating screw and a rest attached to a two arm lever. A spacer is fixed on the frame of the printing machine and bushings which are rigidly connected with aligning elements having eccentric elements adjustably arranged on the spacer. The eccentric is turnably mounted in a block, in which is fixed a connecting screw which is provided with a centering ring and a catch bearing on a bar which is attached to the side wall of the printing machine. On the straightening element is mounted a stop, on which is seated a lever of the eccentric. Further, on the straightening element is fixed a guide piece and one end of a holder is attached to the eccentric, the other end of the holder being provided with a guide roller.

The advantage of the sheet feeder device according to the present invention is in that the device enables the feeding of paper sheets and also of letter envelopes or other envelopes which are longitudinally piled, transversely piled or cross-piled without the need of any auxiliary apparatus to be added to the printing machine, whereby it is not necessary when changing from printing paper sheets to printing letter envelopes and back again, to dismantle a part of the mechanism or to adapt the feeder device for a special printing operation.

Another advantage of the device is in that with the mechanism, according to the invention, can be fed paper sheets and also letter envelopes moving on their feeder path in overlapped arrangement which enables a high printing speed. For the straightening of the sheets and of the pile and advancing the sheets only one mechanism is used which forms part of the device according to the invention which enables easier manipulation for the operator.

A further advantage of the device is the possibility of better adjustment of the straightening elements according to the size of the fed materials to be printed, which is accomplished by means of a quick acting mechanism, whereby the guide rollers are mounted on the straightening elements in such a way that these can be adjusted simultaneously according to the size of the paper sheets or envelopes or similar material to be printed.

Another advantage of the device according to the invention is in that the value of the pressure of the shoe of the feeler element on the pile of sheets can be regulated according to the toughness of the piled paper sheets. Regulation of the pressure of the shoe of the feeler element can also be carried out while the printing operation is proceeding.

IN THE DRAWING

One embodiment of the invention is schematically shown in the accompanying drawings, wherein.

DETAILED DESCRIPTION

Figure 3:
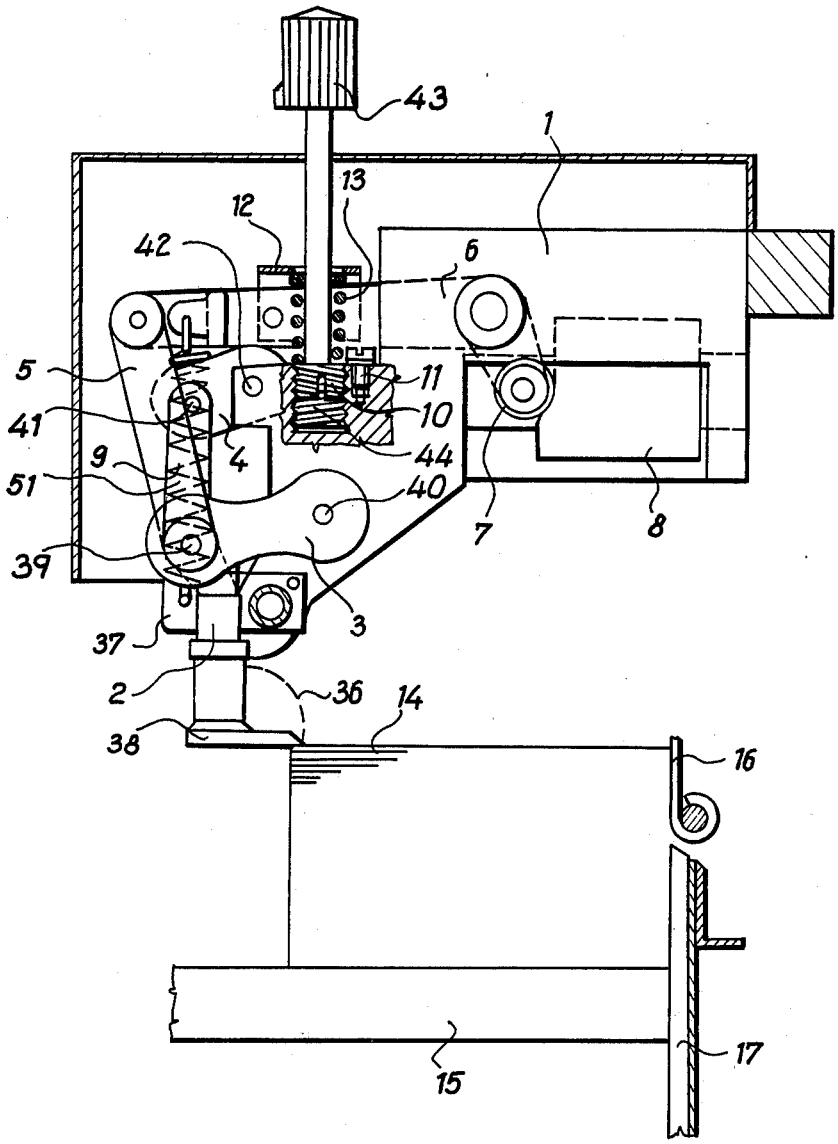
FIG. 3 is a detailed view of the feeder head shown in FIG. 2 bearing on a pile of paper sheets.

Referring first to FIG. 3, the feeder device according to the invention comprises a feeder head 1 which is provided with an adjustable feeler element 2, this feeler element being movably attached to a swing lever 3 and a guide lever 4.

The feeler element 2 is in contact with the top paper sheet of the pile 14 to determine the position of the top of the pile and prevent movement of the top sheet as a sheet is moved to the transporter device 33.

A pressure shoe 38 is screwed onto the end of the feeler element 2. The feeler element 2 is attached to the swing lever 3 by means of a first pin 39 which is pivotably mounted on the feeder head 1 by means of a second pin 40. The upper end of the feeler element 2 is pivotably attached to the guide lever 4 by means of a third pin 41. Guide lever 4 is pivotably attached to the feeder head 1 by means of a fourth pin 42. On the swing lever 3 is mounted one end of a pull rod 5 which is connected at the other end to a two arm lever 6. On the shorter arm of the two arm lever 6 is mounted a follower roller 7 which bears on the functional surface of a drum-shaped cam 8. The follower roller 7 is pressed on the surface of the drum-shaped cam 8 by means of a tension spring 9. The tension spring 9 is attached at one end to one end of the two arm lever 6 and with the other end to a catch 37 which is fixed to the body of the feeder head 1.

In the feeder head 1 is adjustably and threadably mounted a regulating screw 10, the upper position of which is limited by a stop screw 11. The regulating screw 10 is provided at its upper end with a turn knob 43. On the two arm lever 6 is fixed a rest 12, on which bears one end of a pressure spring 13 which is arranged on the regulating screw 10. The pressure spring 13 bears with the second end on a shoulder of the regulating screw 10.

By turning the knob 43, the regulating screw 10 rotates and translates in the threaded hole 44 in the feeder head 1. The regulating screw 10 thereby depresses or releases the spring 13, which acts against tension spring 9, whereby the thrust of pressure shoe 38 on the sheet-pile 14 is regulated. The tension spring 9 acts on the pressure shoe 38 through pull rod 5 by means of two arm lever 6. Pull rod 5 in turn is connected with the swing lever 3 by means of first pin 39.

The shoe 38 of feeler element 2 seats on a pile 14 of paper sheets which are arranged on a feeder table 15 in such a manner that the sheets bear with their front edge on tiltable stops 16 and front bars 17. The pile 14 of paper sheets is stacked between straightening elements 18 (FIG. 1) which are mounted on a sleeve 19 which is shiftably arranged on a spacer 20 which is fixed to the side wall of the printing machine.

Figure 1:
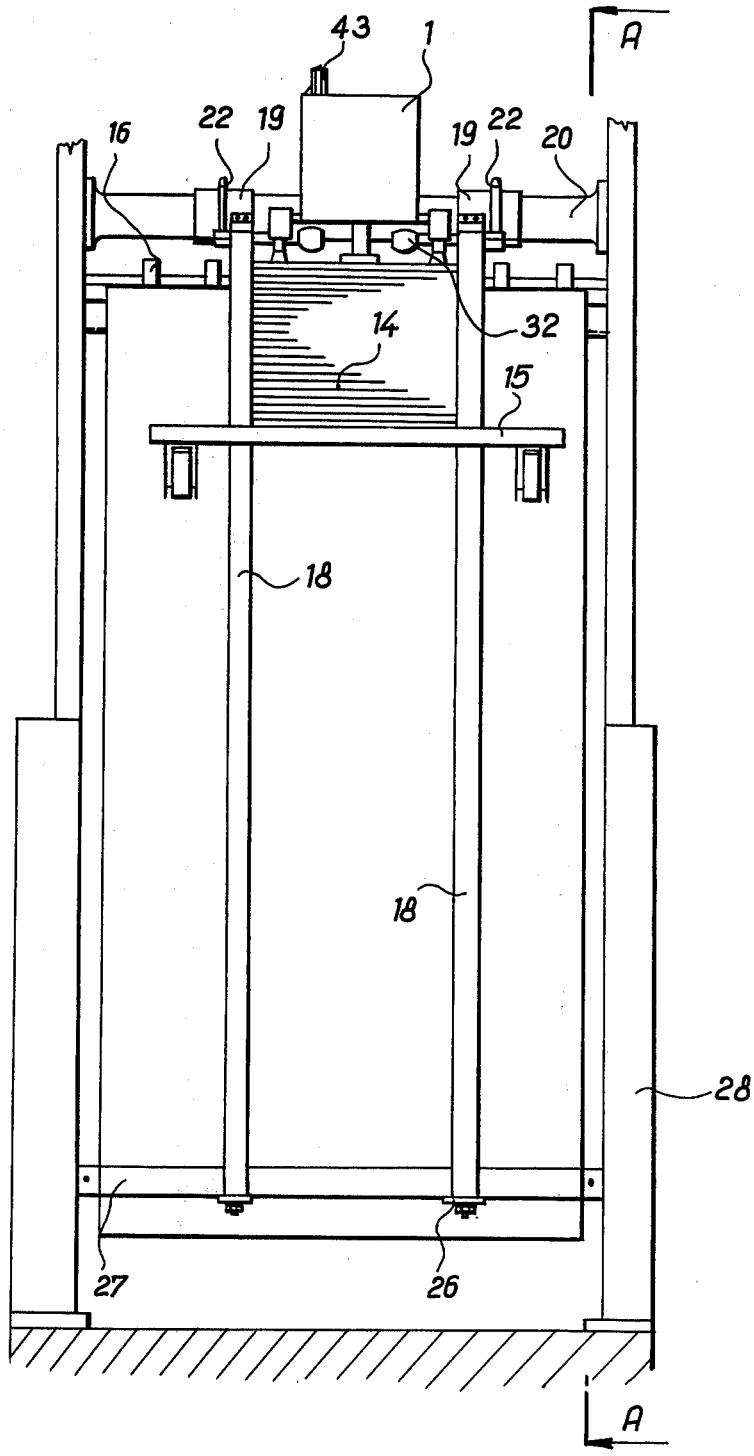
FIG. 1 is a front elevational view of the sheet feeder device of this invention.
Figure 4:
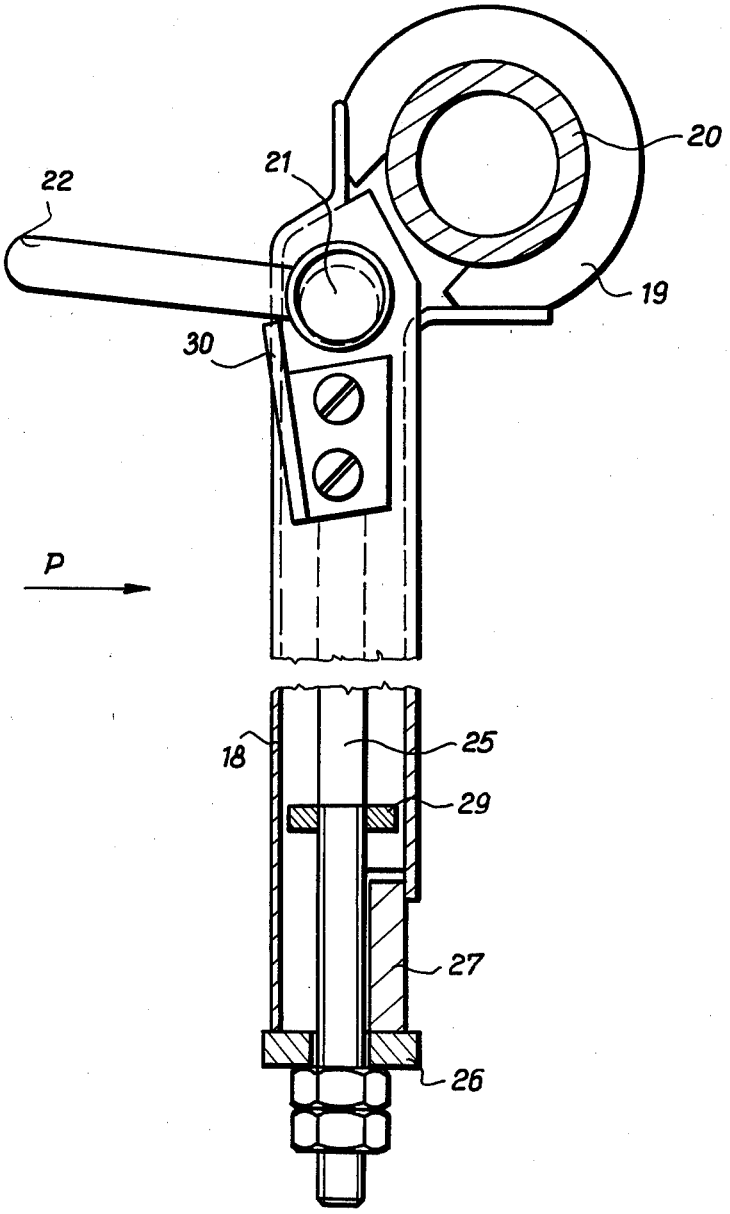
FIG. 4 is a detailed view of a straightening element according to FIG. 2.
Figure 5:
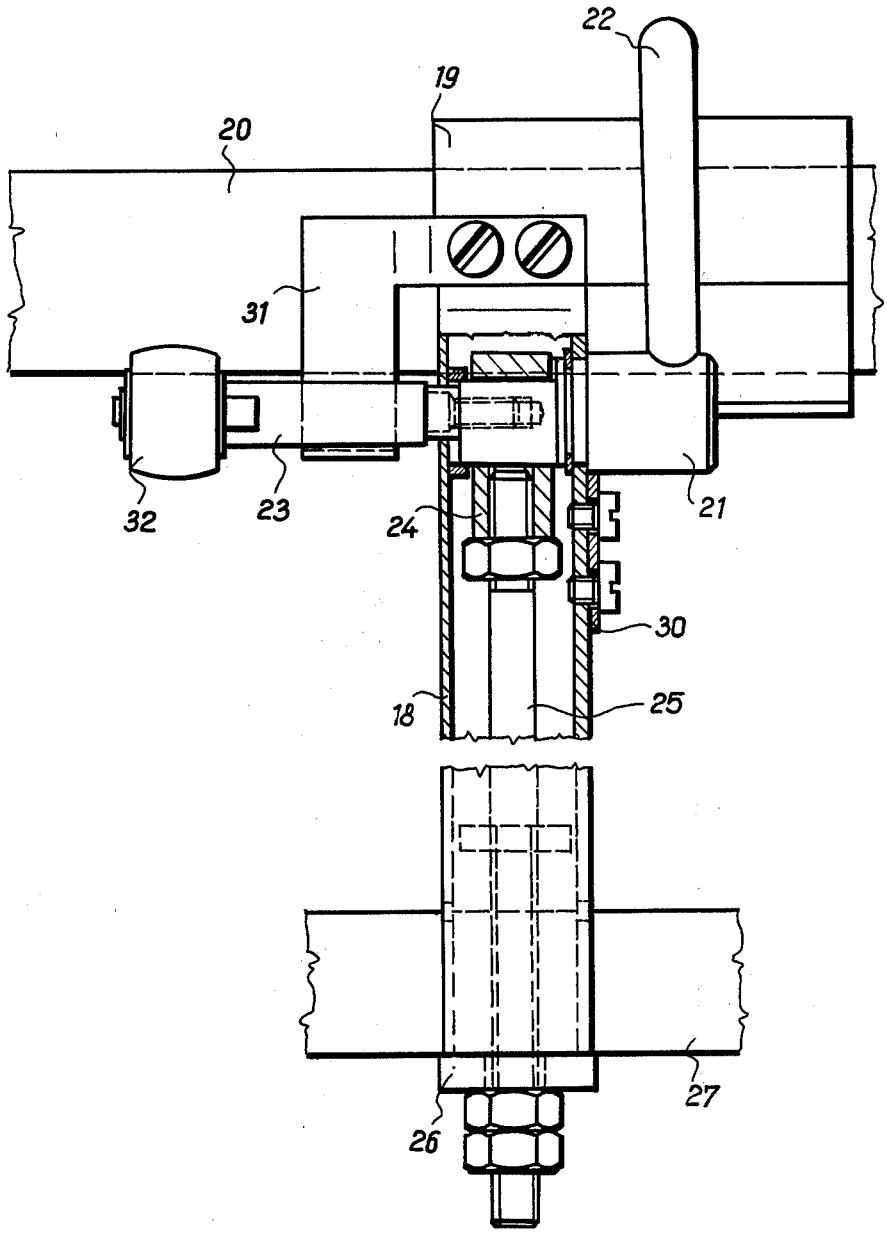
FIG. 5 is an elevational view of a portion of the device according to FIG. 4 seen in the direction "P"

As can be seen in FIGS. 1, 4 and 5, in each straightening element 18 is turnably mounted an eccentric body 21, to which is attached a lever 22 and a holder 23. The eccentric body 21 is turnably arranged in a block piece 24, in which is mounted a connecting screw 25. On the other end of the connecting screw 25, there is mounted a clamp 26 which is pressed by means of a nut on a bar 27. The bar 27 is fixed to frame 28 of the printing machine. On the connecting screw 25 is mounted a centering ring 29. On the straightening element 18 is provided a stop 30 and a guide 31. The end of the holder 23 is provided with a rotatably mounted guide roller 32.

Figure 2:
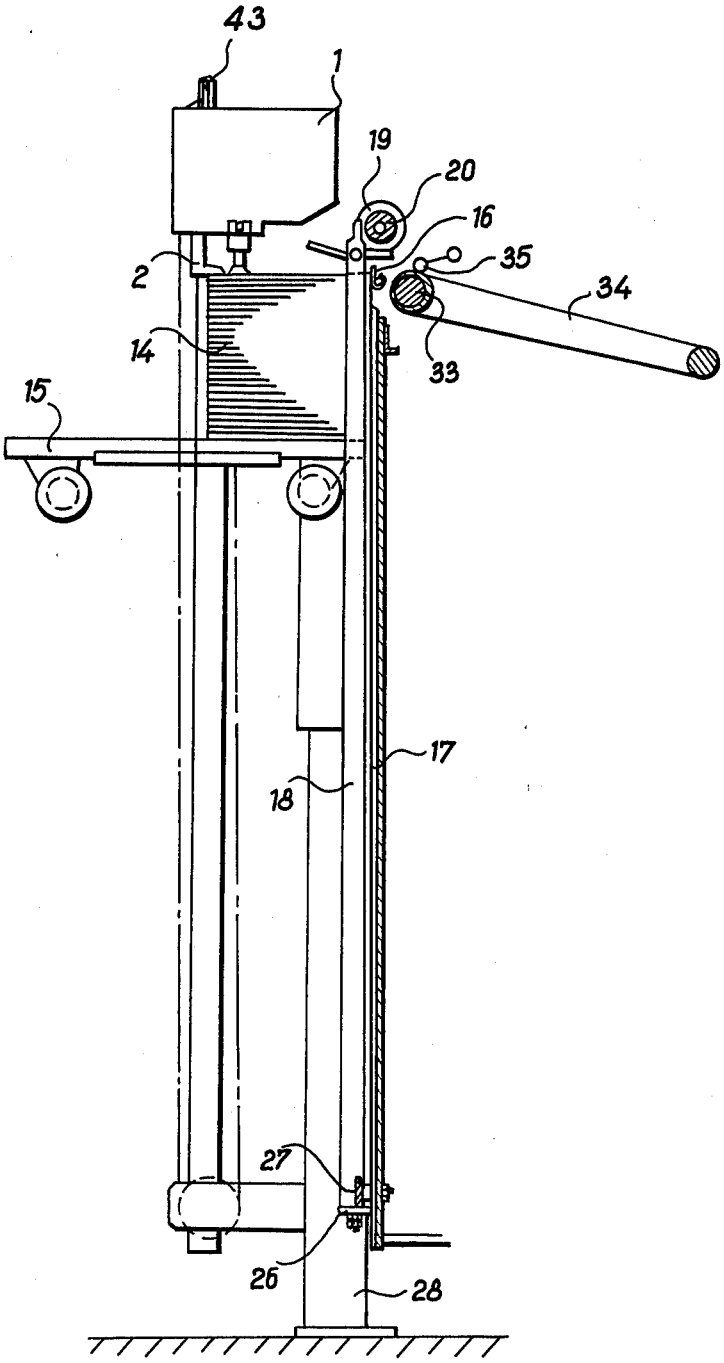
FIG. 2 is a cross-sectional view of the device taken along a plane A—A of FIG. 1.
Figure 6:
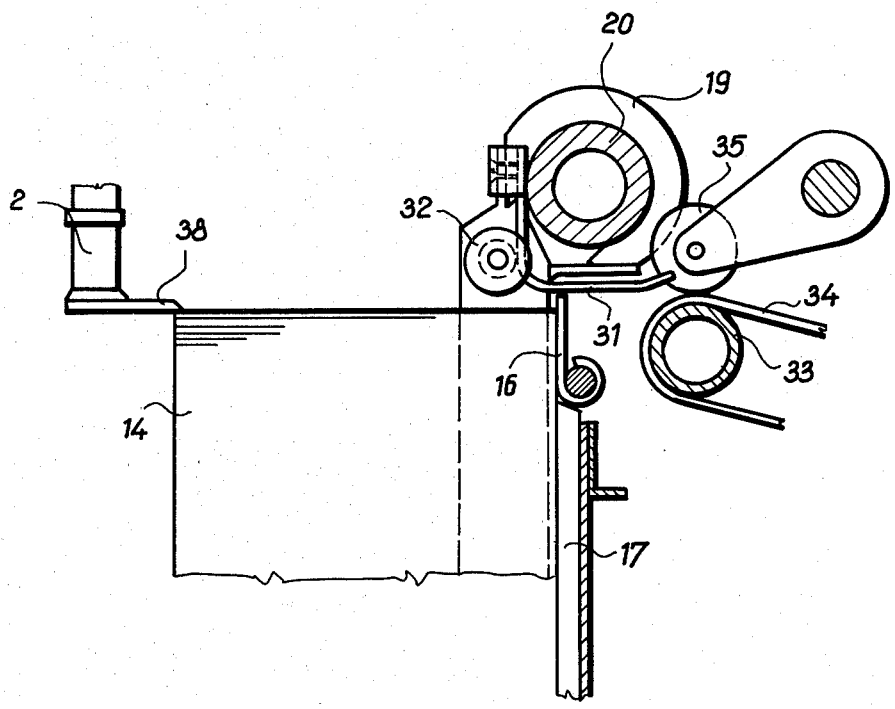
FIG. 6 is a detailed view of the straightening element of FIG. 2, with the mounted guide roller, the guide and a pile of paper sheets.

Referring now to FIGS. 2 and 6, to the feeder device is connected a transport device 33 which is provided with transporting bands 34 and transfer rollers 35. The shoe 38 of the feeler element 2 moves on a path 36 (FIG. 3).

The sheet feeder device works in the following manner: The single paper sheets are taken from the pile 14 by means of the pneumatic feeder head 1 and are pushed between the transfer rollers 35 and the transporting band 34 of the transport device 33. The paper sheets are further transported in overlapped arrangement to the printing mechanism. For the feeding of letter envelopes and other similar materials are provided guide rollers 32 and guides 31 which serve to guide the leading edge of the fed material between the transfer rollers 35 and the transporting bands 34. While feeding paper sheets from a pile 14 of sheets, where the edges of the sheets are not equally tough, as are for example the edges of letter envelopes, the pressure shoe 38 of the feeler element 2 is adjusted by setting the regulating screw 10, thereby adjusting the pressure of spring 13 due to the counter pressure action of the tension spring 9. The result is that the shoe 38 of the feeler element 2 is pressed in its upper position by a maximum pressure of the tension spring 9 and due to that also the follower roller 7 is pressed on the functional path of the drum shaped cam 8. When the feeler element 2 moves on the path 36 in the direction to the pile 14 of sheets, the tension of the tension spring 9 is reduced in such a manner, that the pressure spring 13 is compressed. As a result of this it is possible to regulate the final pressure of the pressure shoe 38 of the feeler element 2 on the edge of the pile 14 of sheets by means of the regulating screw 10. This is carried out, when it is necessary, to regulate the pressure of the shoe according to the thickness of the paper sheets in the pile 14.

Straightening elements 18 are arranged for the lateral guiding and straightening of the pile 14 of sheets. Straightening elements 18 are adjustable according to the size of the sheet material to be printed. The adjusting of the straightening elements 18 is carried out by turning the eccentric 21 by means of the lever 22 in an upwards direction so that the connecting screw 25 with the catch 26 is shifted downwards. A play is thus created between the bar 27 and the straightening element 18 which can be shifted according to need. Then the eccentric 21 is turned as far as the lever 22 seats on the stop 30. The catch 26 is shifted upwards and presses the bar 27 and due to this the straightening element 18 is secured in the required position against shifting movement. In view of the fact that the straightening elements 18 are arranged in the whole height of the feeder, it is possible to place in the lower part of the feeder device, on an auxiliary feeder table 15, another pile 14 of paper sheets.

By turning of the drum shaped cam 8, derived from the follower roller 7, the two arm lever 6 carries out a swinging motion. The two arm lever 6 is connected with one end to the pull rod 5 and as a result a swinging motion is imparted to the swing lever 3 and to the guide lever 4, which is movably attached to the feeler element 2. The pull rod 5 is connected on one hand by means of a pivot fin 39 with the feeler element 2, on the other hand with the swing lever 3. The feeler element 2 is provided with an arm 51 which is connected by means of a second pivot fin 41 with the guide lever 4.

What is claimed is:

1. A sheet feeder device for offset printing machines for feeding paper sheets from a pile to a transporter device which transports the sheets in overlapped arrangement to a printing mechanism comprising a feeder head for feeding the paper to the transport device and a vertically positioned straightening element for maintaining the sheets in alignment, said feeder head having an adjustable pressure feeler element in contact with the top paper sheet of said pile to determine the position of the top of the pile and prevent movement of the top sheet as a sheet is moved to the transporter device, said feeler element being connected to a swing lever, said swing lever being connected to a pull rod which, in turn, is connected to one end of a first lever arm, said first lever arm being connected to a second lever arm having, at its distal end, a following roller which bears on a drum-shaped cam, a regulating screw mounted in said feeder head for adjusting the pressure of said feeler having a pressure spring coaxial with said screw interposed between a shoulder at the lower end of the screw and a rest on the upper surface of said first lever arm, whereby the pressure of said feeler element can be adjusted; and wherein said straightening element abuts the sides of the pile of paper to maintain the sheets in said pile in alignment and comprises vertically arranged hollow tubes having mounted adjacent to their top end a turnably mounted eccentric body having a lever for turning the eccentric and stop means for limiting the travel of the eccentric and a holder for paper guide means, the eccentric being turnably arranged in a block piece to which is attached a connecting element within said hollow tube, said connecting element having attached to its lower end clamping means to engage said machine to lock the straightening elements into position after adjustment.

2. A sheet feeder device according to claim 1, wherein the connecting element is provided with a centering ring at its lower end to contain the connecting element in alignment with the hollow tube and wherein said clamping means bears on a bar affixed to the frame of the printing machine to lock the straightening element into position after adjustment.

3. A sheet feed device according to claim 1 or 2, wherein a paper guide is mounted to the straightening element and the eccentric is attached to one end of a holder on the other end of which is rotatably arranged a guide roller.

* * * * *